US005161916A

United States Patent [19]

White et al.

[11] Patent Number: 5,161,916

[45] Date of Patent: Nov. 10, 1992

[54] SELF-SEATING EXPANSION ANCHOR

[76] Inventors: Claude C. White, 3316 Spring Hill Rd., Birmingham, Ala. 35223; Scott A. White, 5936 Briarwood Ct., Clarkston, Mich. 48346

[21] Appl. No.: 709,349

[22] Filed: Jun. 3, 1991

[51] Int. Cl.[5] ..... E21D 20/02; E21D 21/00

[52] U.S. Cl. ..... 405/259.6; 405/259.4; 411/24; 411/40; 411/55; 411/82

[58] Field of Search ..... 411/24, 26, 55, 60, 411/82, 25, 39, 40; 405/259.1-259.6

[56] References Cited

U.S. PATENT DOCUMENTS

| | | | |
|---|---|---|---|
| 2,879,686 | 3/1959 | Lewis et al. | 405/259.1 X |
| 3,108,443 | 10/1963 | Schuermann et al. | 405/259.6 |
| 3,941,028 | 3/1976 | Lobello et al. | 411/55 |
| 4,611,954 | 9/1986 | Cassidy | 405/259.6 |
| 4,618,291 | 10/1986 | Wright | 405/259.6 |
| 4,662,795 | 5/1987 | Clark et al. | 405/259.6 |
| 4,679,966 | 7/1987 | Yacisin | 405/259.6 |
| 4,789,284 | 12/1988 | White | 411/50 |
| 4,848,971 | 7/1989 | Price | 405/259.1 |
| 5,033,910 | 7/1991 | Wright | 405/259.6 |

*Primary Examiner*—Dennis L. Taylor
*Assistant Examiner*—John Ricci
*Attorney, Agent, or Firm*—Jennings, Carter, Thompson & Veal

[57] ABSTRACT

An expansion anchor received within a predrilled bore for mounting a platelike panel to a portion of stratum in which the bore is drilled and including a bolt having a head on a lower end thereof, an upper portion, distal the head, defining a set of right hand threads thereon and a lower portion, intermediate the upper portion and the head, defining a set of left hand threads thereon. A destructible thrust nut having at least one groove therein is threadably connected to the lower portion and moves upwardly thereon when the rod is rotated in a clockwise direction. A cutting member, having an annular base supported by the thrust nut for sliding movement along the bolt and a plurality of cutting fingers connected to the base in divergent relation to the bolt, is urged upwardly by the thrust nut when the rod is rotated in the predetermined direction. The cutting fingers have at least one blade extending transversely thereon for cutting a groove in the stratum to expand the diameter of the bore a predetermined depth therein. An expansion nut is threadably connected to the upper portion and moves downwardly thereon to expand the cutting fingers and thereby direct the upwardly mobile cutting blades into the stratum. The downward motion of the expansion nut seats the fingers within the grooves cut thereby and secures the bolt within the bore. A rupturable resin container is provided to dispense catalyst activated resin within the bore to further secure the expansion anchor therein.

24 Claims, 4 Drawing Sheets

SELF-SEATING EXPANSION ANCHOR

FIELD OF THE INVENTION

The present invention relates to mechanisms for securing selected objects to a rock formation or stratum. More particularly, the present invention relates to mine roof support bolts and anchor that are received in predrilled bores in such stratum wherein such anchors are expanded therein to engage the sides of the bore and thereby secure the shell and other objects connected thereto to said stratum. In even greater particularly, the present invention relates to expansion anchors having cutting edges thereon for expanding the diameter of the predrilled bore by a predetermined increments such that said expansion anchor can be seated within said expanded portion of said bore to better secure said bolt therein.

BACKGROUND OF THE INVENTION

Expansion anchors can be used to secure selected objects to any sedimentary material such as stone or other masonry; however, an important use of such apparatus is to support the roof of a mine. The roof of a mine shaft is supported by drilling a series of bores in the stratum forming the roof of the mine. Roof straps or roof plates usually constructed of iron or steel are then connected to the roof by inserting elongated mine roof support bolts carrying expansion shells through apertures formed in the roof straps or plates and inserting the expansion shells into the predrilled bores. The mine roof support bolts typically have a head on a lower end thereof or provide for the attachment of a nut thereon to support the roof strap or plate subjacent the roof. Once the expansion shells are received in the predrilled bore they are expanded using apparatus and methods described hereafter to engage and grip the surfaces of the stratum forming the bore thus securing the shell therein. Depending on the apparatus used, the roof strap or plate may be tightened in pressed abutment with the roof as the expansion shell is secured within the predrilled bore or at some time thereafter.

U.S. Pat. No. 1,244,992 issued to Lee on Oct. 30, 1917, discloses an expansion bolt having a flared end and an elongated shaft. The bolt is inserted within a predrilled bore with the flared end being inserted first. A cutting sleeve having a plurality of fingers is inserted within the bore and around the shaft to slide thereon in contact with the flared end. The sleeve is manually driven by repetitive impacts from a driving tool to wedge between the flared end and the wall in which the bore was drilled thereby securing the sleeve and the bolt within the bore. A nut threadably connected to the shaft is used to connect a flange or other object to the bolt and thus to the wall.

U.S. Pat. No. 3,941,028 issued to Lobello et al. on Mar. 2, 1976 discloses an expansion anchor having a threaded bolt with a head on a lower end thereof. A gripping element having a plurality of upwardly extending fingers is connected to the bolt by a lower nut threadably connected to the bolt. Rotation of the bolt urges a tapered nut downward to press the fingers laterally and into the stratum in which the anchor is received. The fingers have ridges thereon that grip the stratum thus inhibiting removal of the anchor. Similar apparatus are disclosed in U.S. Pat. Nos. 3,964,229 and 4,400,122 issued to Fischer and Minnaar et al. respectively.

U.S. Pat. No. 4,789,284 issued to White on Dec. 6, 1988 discloses a self-cutting expansion anchor including an elongated bolt having a head on a lower end thereof. A thrust nut is threadably connected to a lower portion of the bolt and supports a cutting and expanding mechanism having a pair of upwardly extending fingers with cutting blades on the upper ends thereof. A ramp nut is threadably connected to an upper portion of the bolt having tapered grooves therein which receive the cutting finger. A destructible plug received within the ramp plug temporarily secures the ramp plug in non-rotational relation to the elongated bolt. Rotation of the bolt rotates the ramp nut and cutting fingers thereby causing the cutting blades to circumferentially cut and expand the bore in which the expansion anchor is received. The thrust nut urges the cutting fingers upwardly and outwardly during the cutting process. Stops connected to the fingers will eventually contact the walls of the bore and stop the rotation of the fingers and the ramp nut. Continued rotation of the bolt will disintegrate the destructible plug and urge the ramp nut downward to press the fingers against the walls of the expanded bore.

Of the aforecited art, Lobello et al., Fischer and Minnaar et al. do not provide apparatus for expanding the diameter of the bore. Such expansion is a crucial component in maximizing the gripping capacity of an expansion anchor.

Lee provides apparatus for expanding the diameter of the bore but does not provide apparatus for exerting radial pressure on the sleeve after the sleeve has been driven into the bore. The sleeve dislodges a portion of the wall forming the bore and when driven therein, fills the void left by the dislodged portions of the wall; however, without additional radial pressure exerted on the sleeve, the sleeve could be susceptible to slippage. Lee requires several steps to complete connection of the selected object to the wall. The bolt must be inserted within the bore, the sleeve manually fitted over the shaft and driven into the bore, the driving tool disconnected from the sleeve and the selected object connected to the bolt with a nut. Repetitive use of the expansion bolt disclosed in Lee would require a substantial amount of manpower work hours resulting in significant expense to the cost of operating the mine.

White provides an expansion anchor that exerts additional radial force against the cutting blades once the blades have circumferentially cut a predetermined conical notch in the diameter of the bore. Furthermore, White provides an expansion anchor that will connect a roof strap in two easy steps, insertion of the anchor within the bore and rotation of the bolt head. Though very effective for the purpose intended, White is limited to use in relatively soft rock formations. The circumscriptive cutting action of the blades must meet little resistance as over exertion on the blades will disintegrate the destructible plug thereby terminating the rotation of the cutting fingers. Furthermore, the thrust nut can only move upwardly if the rock formation is soft enough to permit the stop members connected to the thrust nut and the cutting fingers to gouge a vertical furrow through the rock formation.

SUMMARY OF THE INVENTION

It is the principal object of the present invention to provide an expansion anchor that will expand the diameter of a predrilled bore a predetermined depth therein.

In support of the principal object, another object of the present invention is to provide an expansion anchor that expands within the expanded portion of the bore to secure itself therein.

Yet another object of the present invention is to provide an expansion anchor that maximizes the cutting force exerted thereby.

Still another object of the present invention is to provide an expansion anchor that indicates when a predetermined amount of torquing force has been applied thereto.

These and other objects and advantages of our invention are accomplished through the use of an elongated bolt member having a polygonal head on a lower end thereof. The bolt member has a set of right hand threads on an end thereof distal the head and a set of left hand threads intermediate the head and the right hand threads. A thrust nut is threadably connected to the left hand threads and supports an annular base encircling the bolt member. A plurality of cutting fingers are connected to the annular base and extend upwardly therefrom in divergent relation to the bolt member. Each cutting finger has a cutting blade on an upper end thereof for cutting in substantially parallel relation to the longitudinal axis of the cutting finger. An alternate embodiment provides for a plurality of parallel cutting edges extending substantially transverse the longitudinal axis of the cutting finger on an outer side thereof for cutting a groove substantially parallel such longitudinal axis. An expansion nut is connected to the right hand threads and has a smaller end received intermediate the plurality of cutting fingers. A plurality of planar surfaces are formed on the smaller end and are each contacted by a radially inward face of one of the plurality of cutting fingers.

The expansion anchor is typically inserted within a predrilled bore in a roof of a mine, such roof being the stratum through which said mine extends. A resin capsule having a destructible sheath and a quantity of resin and micro encapsulated catalyst therein is threadably connected to the bolt member and is inserted within the bore prior to insertion of the remaining components of the anchor. Insertion of the bolt member thereafter will rupture the resin capsule and discharge the resin and ruptured catalyst therefrom. The resin is activated by the ruptured catalyst and will seep intermediate the aforementioned components of the anchor. After the anchor has been actuated, the resin will set to a hardened consistency and adhere to the anchor and bore to further secure the anchor therein. Once the anchor is received within the bore, the head is rotated clockwise thereby urging the thrust nut upwardly and the expansion nut downwardly. Only the bolt member is rotated; the frictional contact of the expansion and compression nuts with the cutting fingers and annular base, respectively, securing these components in non-rotating relation to the stratum in which they are received. Continued rotation of the bolt member urges the cutting fingers upwardly and outwardly across the downwardly moving planar surfaces and into the stratum. The cutting edges are driven into the stratum and dislodge a portion thereof to form a set of grooves therein. The cutting edges may be chevroned to urge the dislodged portions of stratum from the path of the cutting fingers and to maximize the shear forces exerted on the stratum adjacent the cutting edges. The downward movement of the expansion nut urges the fingers radially outwardly thus seating the fingers in the grooves. The radial expansion of the cutting fingers by the expansion nut maximizes the gripping force exerted by the fingers on the stratum and thereby secures the expansion anchor within the bore. The thrust nut has at least one groove formed therein that reduces the structural integrity of the thrust nut such that a predetermined torque exerted on the bolt member will disintegrate the nut and thereby indicate that the requisite amount of torque was exerted. Once the thrust nut is disintegrated, continued rotation of the bolt member within the expansion nut will draw the rod member into the bore, thereby drawing any object supported by the head in pressed abutment with the roof.

BRIEF DESCRIPTION OF THE DRAWINGS

Apparatus embodying features of our invention are depicted in the accompanying drawings which form a portion of this disclosure and wherein.

DESCRIPTION OF A PREFERRED EMBODIMENT

Figure 1:
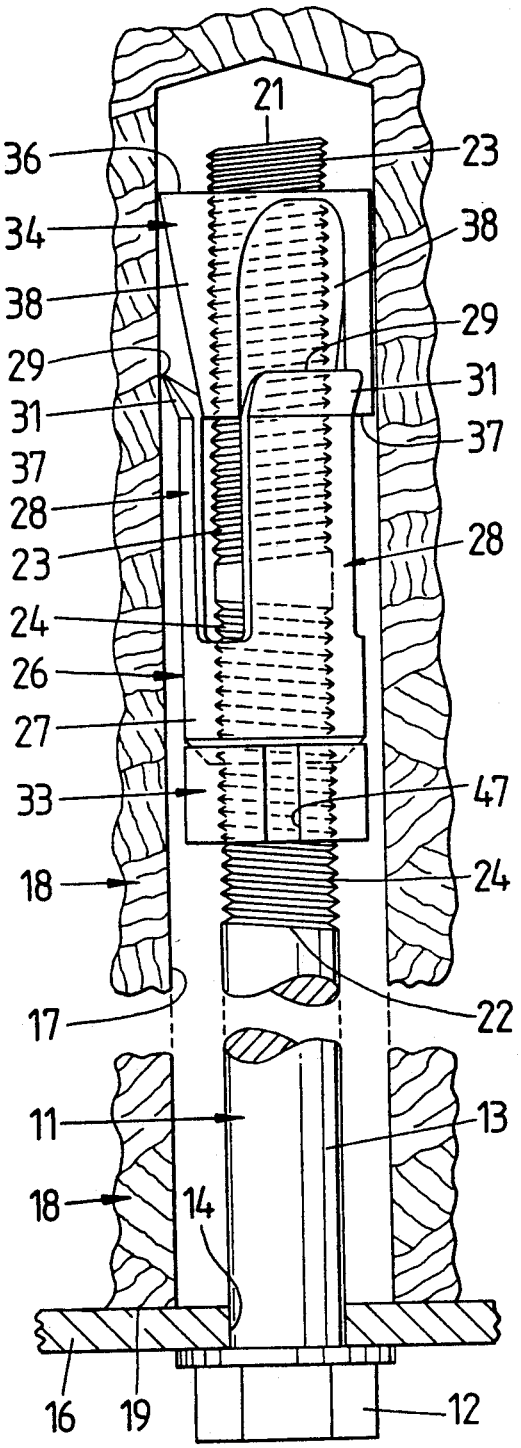
FIG. 1 is a side elevational view of a first embodiment of the present invention received within a bore.
Figure 2:
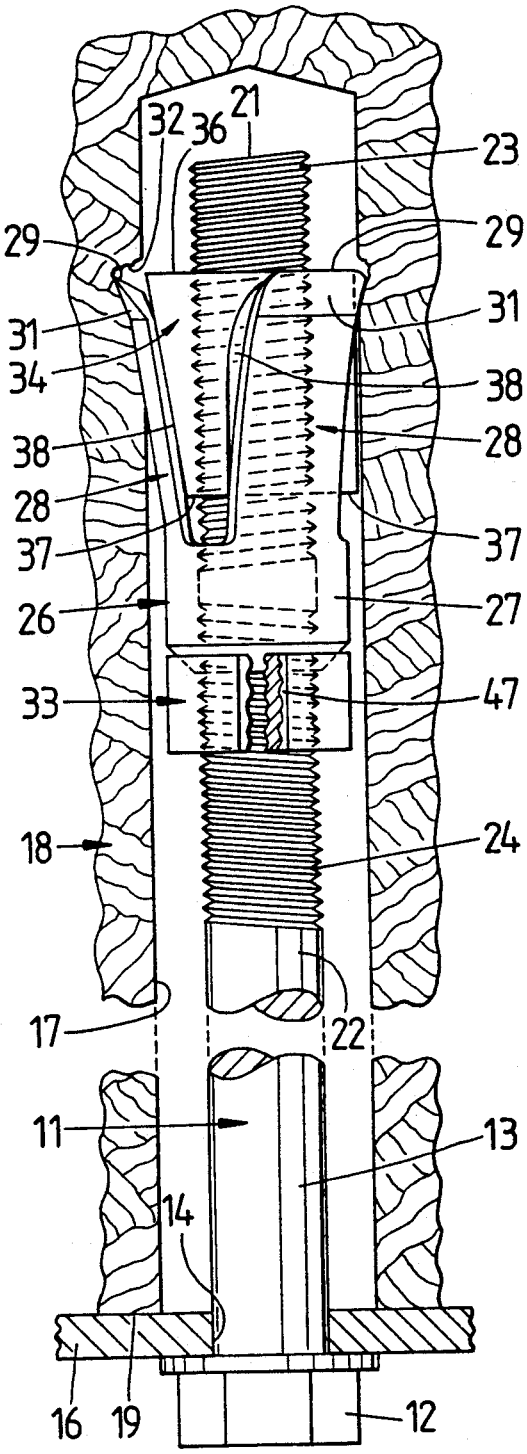
FIG. 2 is a side elevational view of a first embodiment of the present invention after the bolt member has been rotated to drive the cutting fingers within the stratum.

Referring to the drawings for a clearer understanding of the invention it should be noted in FIGS. 1 and 2 that a first embodiment of the present invention includes an elongated bolt 11 having a head 12 connected to a lower end 13 thereof. The bolt 11 extends through an aperture 14 in a roof strap 16 or other platelike member which rests on the head 12 and is supported thereby. The bolt member 11 is typically received in a bore 17 that was predrilled in a stratum 18 forming a roof 19 of a mine.

Figure 3:
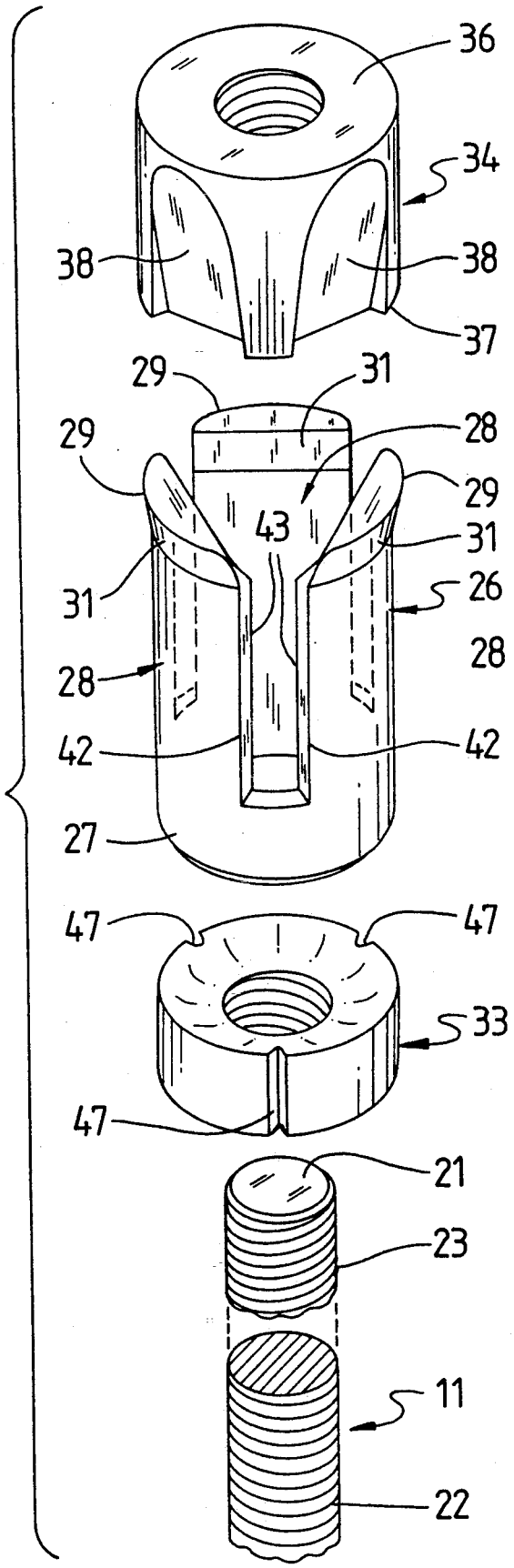
FIG. 3 is an exploded enlarged perspective view of the present invention.

The bolt has an upper portion 21 distal the head 12 and a lower portion 22 intermediate the head 12 and upper portion 21. The upper portion defines a set of right hand threads 23 whereas the lower portion defines a set of left hand threads 24. A cutting member 26 is slidably connected to the bolt for expanding the diameter of the bore 17 at a predetermined depth therein. As shown in FIG. 3, the cutting member includes an annular base 27 circumscribing the bolt 11 and a plurality of cutting fingers 28 integrally connected to the annular base 27 and extending away from the head 12 in divergent relation to the bolt 11. Each cutting finger has a cutting edge 29 formed substantially transversely thereto on an upper end 31 thereof for cutting a vertically extending groove 32 in the stratum 18. The cutting member 26 is supported by a thrust nut 33 threadably connected to the lower portion 22. The thrust nut 33 moves upwardly along the bolt 11 when the bolt 11 is rotated in a predetermined direction such that the thrust nut 33 urges the cutting member 26 upwardly along the bolt 11.

An expansion nut 34 is threadably connected to the upper portion 21 and moves downwardly thereon when the bolt 11 is rotated in the predetermined direction. The expansion nut has an upper end 36 and a lower end 37. The lower end extends intermediate the upper ends 31 of the cutting fingers 28 and defines a plurality of planar surfaces 38 against each of which one of the cutting fingers 28 is slidingly abutted. The planar surfaces 38 converge downwardly and serve as a guideway along which the cutting fingers 28 may travel in non-rotating relation to the expansion nut 34 and the stratum 18. The thrust nut 33 similarly does not rotate in relation to the cutting member 26 or expansion nut 34 as the frictional force between the annular base 27 and the thrust nut 33 is sufficient to overcome the angular forces exerted by the bolt 11 on the thrust nut. As shown in FIGS. 1–3, the thrust nut 33 is recessed on an upper end thereof to receive a tapered lower end of the annular base 27 thus maximizing the frictional contact surface therebetween and exerting a bursting force on thrust nut 33.

Figure 4:
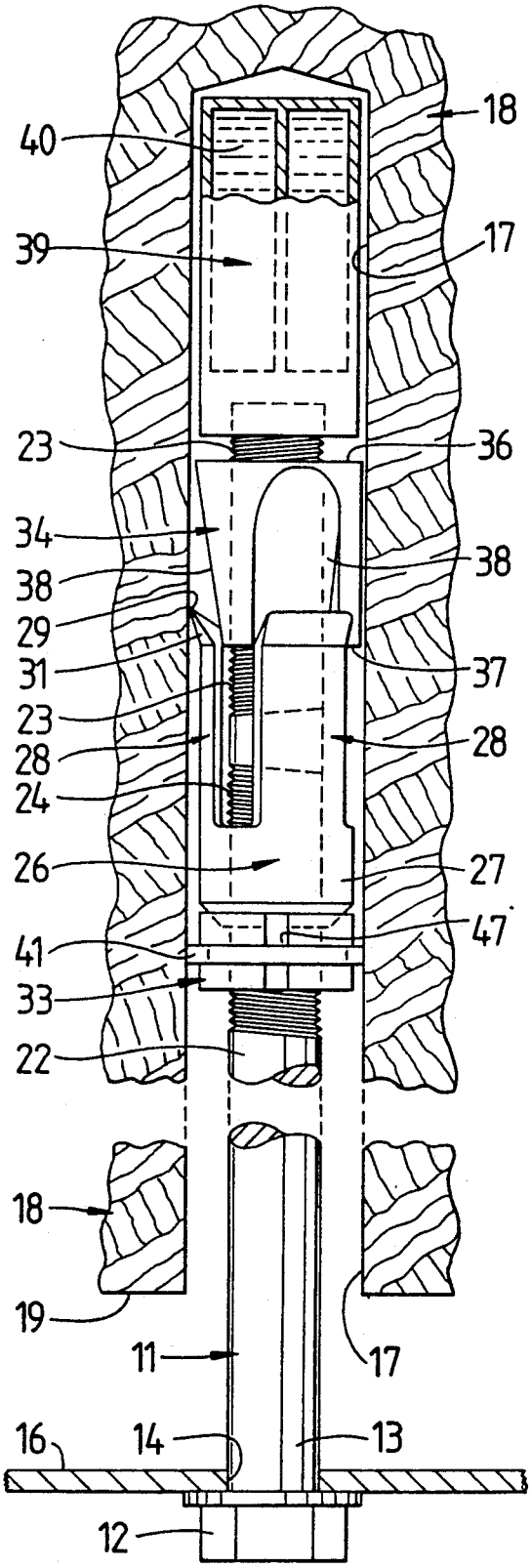
FIG. 4 is a side elevational view of a second embodiment of the present invention partially received within a bore.
Figure 5:
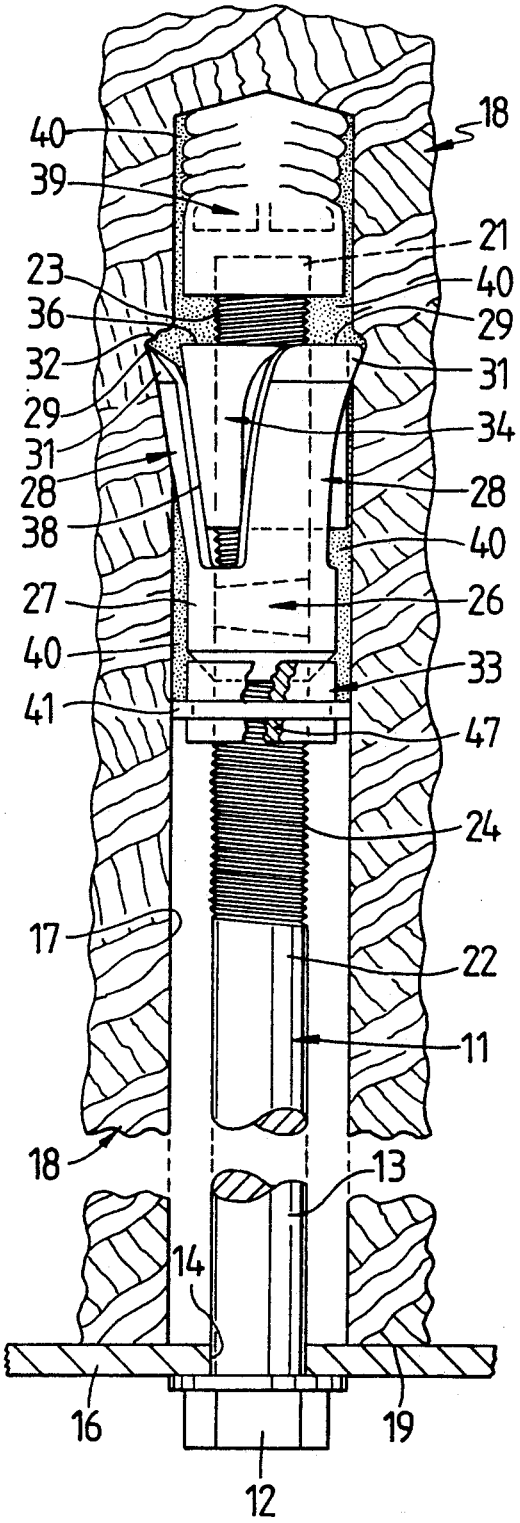
FIG. 5 is a side elevation view of the second embodiment of the present invention fully received within the bore and rotated to drive the cuttings fingers within the stratum.

As shown in FIGS. 4 and 5, a second embodiment of the present invention includes a resin capsule 39 threadably connected to the upper portion and containing a quantity 40 of micro encapsulated catalyst and catalyst activated resin. The capsule 39 enters the bore 17 first as the bolt 11 is inserted therein. Complete insertion of the bolt 11 within the bore 17 will rupture the capsule 39, as is shown in FIG. 5, causing the catalyst to rupture and resin to gravitationally migrate intermediate the components of the present invention and the bore 17. A seal 41 such as an O-ring is connected to the thrust nut 33 to prevent the resin from passing therebelow and thereby contains the resin and catalyst proximal the cutting fingers 28. After the capsule 39 is ruptured, the head 12 and thus the bolt 11 are rotated clockwise thereby urging the thrust nut 33 upwardly and the expansion nut 34 downwardly along their respective threads 24 and 23. This movement together with crushing of the capsule activates the resin. As is shown in FIGS. 2 and 5, the upward movement of the thrust nut 33 urges the cutting member 26 upwardly whereas the downward movement of the expansion nut 34 directs the cutting fingers 28 outwardly and into the stratum 18 to form the grooves 32. The downward movement of the expansion nut 34 also exerts forces transversely against the upwardly and outwardly extended cutting fingers 28 to press the cutting fingers 28 against the stratum 18. This yields maximum force applied at the cutting edges 29. The amount of force exerted transversely on the cutting fingers 28 increases proportionally with the continued rotation of the bolt 11. As shown in FIG. 3, the cutting fingers 28 have smooth outer and inner sides 42 and 43 which minimize the frictional resistance exerted by the stratum 18 and planar surfaces 38 against the cutting fingers 28 thus facilitating maximum penetration of the stratum 18 thereby.

Figure 6:
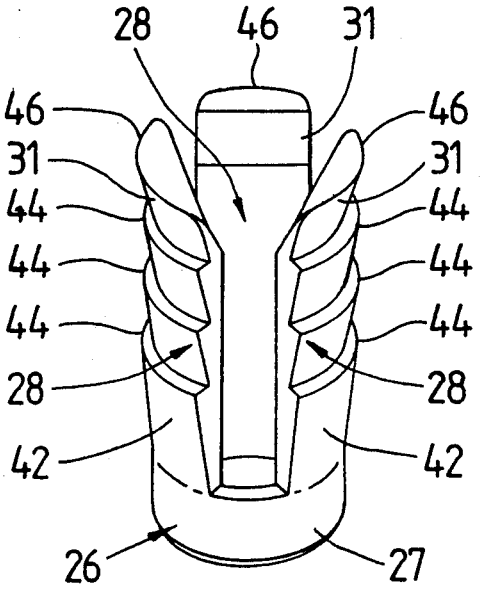
FIG. 6 is a perspective view of a cutting member of a third embodiment of the present invention.
Figure 7:
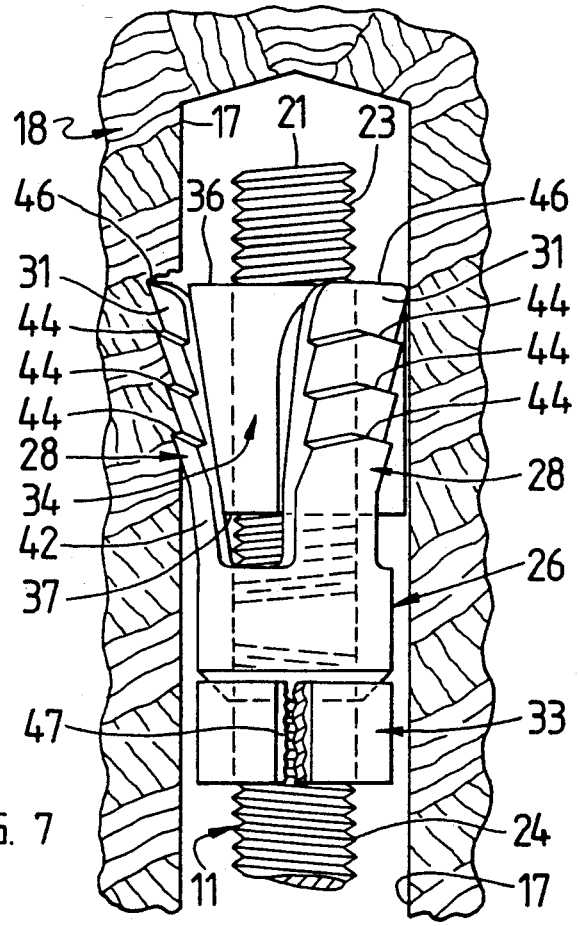
FIG. 7 is a side elevational view of the third embodiment of the present invention.
Figure 8:
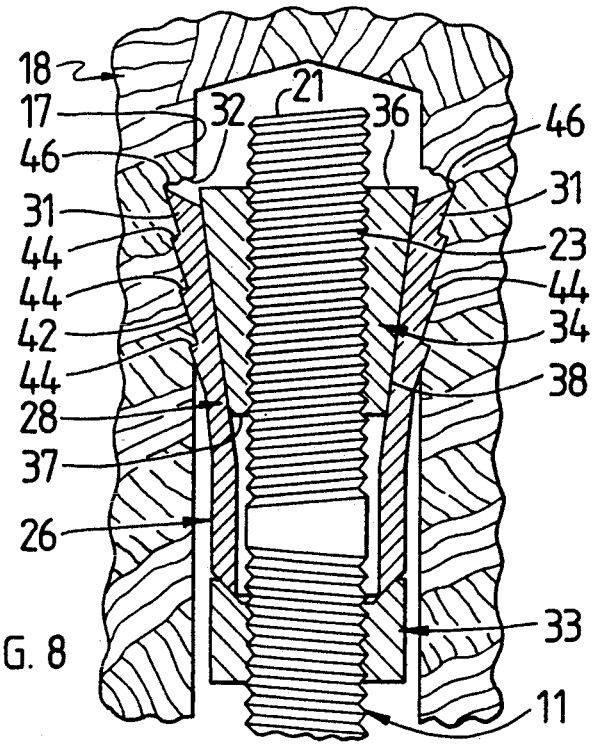
FIG. 8 is a sectional view of the third embodiment of the present invention.

As shown in FIGS. 6–8, an alternate embodiment provides cutting fingers 28 having a plurality of parallel cutting edges 44 extending substantially transversely thereon along the outer sides 42 and upper ends 31 thereof. As shown in FIG. 7, the cutting edges 44 may be chevroned to urge dislodged portions of stratum 18 from the cutting path of cutting fingers 28. As the cutting member 26 is urged upwardly, an uppermost cutting edge 46 initiates the cutting of groove 32. The uppermost edge 46 is progressively followed by the remaining cutting edges 44 which continue to expand the diameter of the bore 17 at all points along the length of the cutting fingers 28 that are in contact with the stratum 18. This continual expansion along all points of the cutting fingers 28 reduces the frictional forces exerted on the cutting fingers 28 by allowing room for the downward movement of the expansion nut 34 and thereby permits deeper penetration of the stratum 18 by the cutting finger 28.

Regardless of which embodiment is used, frictional resistance on the cutting fingers will be experienced and will correspondingly result in an increased resistance to the torquing force applied to rotate the head 12 and bolt 11. Certain predetermined torquing forces are required to urge the cutting fingers a satisfactory distance into differing stratum. As shown in FIGS. 1–5 and 7, grooves 47 are formed in thrust nut 33 and reduce the structural integrity thereof such that a predetermined thrust force exerted on the thrust nut 33 by a predetermined torquing force exerted on the bolt 11 will disintegrate the thrust nut 3 thereby indicating to the user that the required torquing force had been exerted. Continued rotation of the bolt 11 after disintegration of the thrust nut will draw the bolt 11 upward within the expansion nut 34 and will thereby draw the roof strap 16 in tightened abutment with the roof 19.

After the aforementioned steps are completed and the roof strap 16 is tightened against the roof 19, the resin 40 will set to a hardened consistency. The resin 40 in its hardened state will bond with the bolt 11, cutting member 26, tapered nut 34 and stratum 18 to further secure the bolt 11 therein. Furthermore, the hardened resin 40 will seal the anchor from water and prevent the tapered nut 34 from potentially slipping within the cutting fingers 28 thereby reducing loss of tension in the bolt 11. It should be note that either embodiment of the present invention may be used as an extension of other roofbolts where local conditions in the mine require it. From the foregoing, it should be clear that the present apparatus represents a substantial improvement over the prior art.

While we have shown our invention in two forms, it will be obvious to those skilled in the art that it is not so limited but is susceptible of various changes and modifications without departing from the spirit thereof.

What we claim is:

1. A mine roof anchor received within a predrilled bore for mounting a roof strap or other platelike panel to a stratum in which said bore is drilled, comprising:

(a) an elongated bolt having a head on a lower end thereof, said bolt extending through said platelike panel and within said bore with said head supporting said platelike member in pressed abutment with said stratum;

(b) means slidably mounted to said bolt for axial movement therealong in non-rotating relation to said bore and for expanding the diameter of said bore a predetermined increment therein, wherein said means has an annular base slidingly engaging said bolt and a plurality of cutting fingers integrally connected to said annular base and extending distal said lower end in divergent relation to said bolt, wherein each said cutting fingers has a substantially transverse cutting blade forming an upper end thereof distal said annular base for cutting a vertical groove in said stratum substantially axially with said bore when said fingers are urged along said bolt in non-relating relation to said bore;

(c) means threadably connected to said bolt intermediate said expanding means and said head for urging said expanding means upwardly from said head in axial non-rotating relation to said bore and into said stratum when said bolt is rotated in a predetermined direction, said urging means comprising a thrust nut threadably connected to said bolt for supporting said expanding means, said thrust nut including means for reducing the structural integrity of said thrust nut such that a predetermined thrust force created by the exertion of a predetermined torquing force on said bolt and a resistive force created by the frictional contact of said cutting fingers with said stratum will disintegrate said thrust nut; and (d) means threadably connected to said bolt and distal said head for urging said cutting fingers outwardly from said bolt and into said stratum when said expanding means is urged axially along said bolt away from said head, wherein said outwardly urging means is partially tapered and moves downwardly in non-rotating relation to said bore and against said upwardly urged fingers when said bolt is rotated a predetermined direction about its longitudinal axis.

2. An anchor as described in claim 1 further comprising a rupturable resin capsule threadably connected to an uppermost end of said upper portion.

3. An expansion bolt as described in claim 2 wherein said resin comprises micro-encapsulated catalyst therein that rupture, when said elongated bolt is inserted within said bore, to activate said resin from a liquid to a hardened solid consistency.

4. A mine roof anchor received within a predrilled bore for mounting a roof strap or other platelike panel to a stratum in which said bore is drilled, comprising:

(a) an elongated bolt having a head on a lower end thereof, said bolt extending through said platelike panel and within said bore with said head supporting said platelike member in pressed abutment with said stratum;

(b) means slidably mounted to said bolt for axial movement therealong in non-rotating relation to said bore and for expanding the diameter of said bore a predetermined increment therein, wherein said means has an annular base slidingly engaging said bolt and a plurality of cutting fingers integrally connected to said annular base and extending distal said lower end in divergent relation to said bolt, wherein each said cutting finger has a substantially transverse cutting blade forming an upper end thereof distal said annular base for cutting a vertical groove in said stratum substantially axially with said bore when said fingers are urged along said bolt in non-relating relation to said bore;

(c) means threadably connected to a lower portion of said bolt having left hand threads therein, intermediate said expanding means and said head for urging said expanding means upwardly from said head in axial non-rotating relation to said bore and into said stratum when said bolt is rotated in a predetermined direction, said urging means comprising a thrust nut threadably connected to said bolt for supporting said expanding means, said thrust nut having at least one groove thereon for reducing the structural integrity of said thrust nut such that a predetermined thrust force created by the exertion of a predetermined torquing force on said bolt and a resistive force created by the frictional contact of said cutting fingers with said stratum will disintegrate said thrust nut thereby indicating that said predetermined torquing force was achieved; and (d) means, threadably connected to an upper portion of said bolt having right hand threads thereon and distal said head, for urging said cutting fingers outwardly from said bolt and into said stratum when said expanding means is urged axially along said bolt away from said head, wherein said outwardly urging means is partially tapered and moves downwardly in non-rotating relation to said bore and against said upwardly urged fingers when said bolt is rotated a predetermined direction about its longitudinal axis.

5. An anchor as described in claim 4 wherein said cutting fingers each have a smooth, rounded outer side for minimizing the frictional forces between said fingers and said stratum.

6. An anchor as described in claim 4 wherein said outwardly urging means comprises an expansion nut threadably connected to said upper portion and having an outer surface tapering from an upper end to a lower end.

7. An anchor as described in claim 4 wherein said expansion nut has a plurality of planar surfaces spaced thereon and converging at said lower end, wherein each of said plurality of cutting fingers extends in planar abutment with one of said plurality of planar surfaces such that said fingers secure said expansion nut in non-rotating relation thereto and slide upwardly along said planar surfaces and into said stratum when said expansion nut moves downwardly and said fingers are urged upwardly along said bolt in non-rotating relation to said stratum.

8. An expansion anchor bolt received within a predrilled bore for mounting a platelike panel to a portion of stratum in which said bore is drilled, comprising:

(a) an elongated bolt having a head on a lower end thereof, said bolt extending through said platelike panel and within said bore with said head supporting said platelike member in pressed abutment with said stratum;

(b) means mounted to said bolt for expanding the diameter of said bore a predetermined increment, wherein said expanding means seats within said expanded diameter to vertically secure said bolt within said bore; and (c) a thrust nut threadably connected to said bolt intermediate said expanding means and said head for urging said expanding means upwardly from said head when said bolt is rotated in a predetermined direction, wherein said thrust nut has at least one groove therein for reducing the structural integrity of said thrust nut such that a predetermined amount of torquing force exerted on said bolt will disintegrate said nut thus indicating that said predetermined torque was exerted.

9. An expansion anchor as described in claim 8 wherein said elongated bolt comprises:

(a) an upper portion having right hand threads thereon; and (b) a lower portion having left hand threads thereon to which said thrust nut is threadably connected, wherein rotation of said bolt in a predetermined direction urges said thrust nut upwardly such that said expanding means supported by said thrust nut is also urged upwardly and wherein said frictional contact of said thrust nut with said expanding means secures said thrust nut in non-rotating relation therewith.

10. An expansion anchor as described in claim 9 wherein said expanding means comprises:

(a) an annular base slidingly mounted to said bolt and supported thereon by said thrust nut; and (b) at least one cutting finger integrally connected to said base and extending upwardly therefrom in divergent relation to said bolt.

11. An expansion anchor as described in claim 10 wherein each said cutting finger comprises a cutting edge formed on an upper end thereof distal said annular base, wherein each said cutting edge extends in substantially transverse relation to the longitudinal axis of said finger and is driven into said stratum to cut a groove therein when said cutting finger is urged upwardly by the upward movement of said thrust nut.

12. An expansion anchor as described in claim 11 wherein said cutting fingers have a smooth, rounded outer side for minimizing the frictional forces between said fingers and said stratum.

13. An expansion anchor as described in claim 10 wherein each said cutting finger comprises a plurality of substantially parallel cutting edges extending on an outer side thereof in substantially transverse relation to said cutting finger.

14. An expansion anchor as described in claim 13 wherein said plurality of cutting edges are chevroned to urge portions of said stratum dislodged by said cutting edge laterally of said upwardly urged cutting fingers.

15. An expansion anchor as described in claim 10 further comprising an expansion nut threadably connected to said upper portion and partially tapered from an upper end to a lower end, said lower end being received intermediate said divergent cutting fingers, wherein rotation of said bolt in said predetermined direction urges said expansion nut downward to laterally expand said cutting fingers concurrently with the upward movement thereof.

16. An expansion anchor as described in claim 15 wherein said expansion nut defines a plurality of planar surfaces extending upwardly and diverging outwardly from said lower end thereof, wherein each of said plurality of cutting fingers contacts one of said plurality of planar surfaces and slides upwardly and outwardly thereon in non-rotating relation to said expansion nut and said stratum when said expanding means is urged upwardly by the upward movement of said thrust nut on said threaded lower portion.

17. An expansion bolt as described in claim 8 further comprising a rupturable resin capsule threadably connected to an uppermost end of said upper portion wherein said resin capsule contains a quantity of resin and micro-encapsulated catalyst therein.

18. An expansion bolt as described in claim 17 further comprising a seal connected to said thrust nut and sealably contacting said stratum and preventing the passage of said resin below said thrust nut.

19. A self-securing expansion anchor received within a predrilled bore for mounting a roof strap or other platelike panel to a stratum in which said bore is drilled, comprising:

(a) an elongated bolt having a head on a lower end thereof, said bolt extending through said platelike panel and within said bore with said head supporting said platelike member in pressed abutment with said stratum;

(b) a thrust nut threadably connected to a lower portion of said bolt for axial movement thereon having at least one groove therein for reducing the structural integrity of said thrust nut such that a predetermined torquing force exerted on said bolt will disintegrate said nut and thereby indicate that said predetermined torquing force was exerted, wherein said thrust nut is held in non-rotating relation to said stratum by the frictional contact of said cutting fingers with said stratum and the frictional contact of said thrust nut with an annular base;

(c) an annular base slidably mounted to said bolt and supported by said thrust nut for concomitant movement therewith;

(d) at least one cutting finger integrally connected to said annular base in divergent relation to said bolt and urged upwardly in non-rotating relation to said stratum by said axial movement of said thrust nut to cut at least one groove in said stratum substantially parallel to said bolt and to concurrently seat itself in said groove to secure said bolt within said bore, wherein each said cutting finger has a plurality of substantially parallel cutting edges spaced along a longitudinal axis thereof and extending in substantially transverse relation thereto on an outer side thereof; and (e) means threadably connected to an upper portion of said bolt for urging said cutting fingers outwardly from said bolt to cut said groove and seat therein.

20. An expansion anchor as described in claim 19 wherein said lower portion has a set of left hand threads formed thereon to which said thrust nut is threadably connected and said upper portion has a set of right hand threads formed thereon to which said outwardly urging means is threadably connected, wherein rotation of said bolt in a predetermined direction urges said outwardly urging means downwardly and said thrust nut, annular base and cutting fingers upwardly.

21. An expansion anchor as described in claim 20 wherein said outwardly urging means comprises an expansion nut threadably connected to said upper portion and having an upper end and a lower end, wherein said lower end is received intermediate said cutting fingers in pressed radial abutment therewith.

22. An expansion anchor as described in claim 21 wherein said expansion nut has at least one planar surface, extending in downwardly converging relation to said elongated bolt, against which one of said cutting fingers are pressed in sliding non-rotating relation thereto, wherein rotation of said bolt urges said cutting fingers upwardly and outwardly in non-rotating relation to said stratum such that said cutting edges are urged therein to dislodge portions of said stratum and cut said grooves therein.

23. An expansion anchor as described in claim 22 wherein said cutting edges are chevroned to urge said dislodged portions of said stratum laterally from said upwardly urged cutting fingers.

24. A self-securing expansion anchor typically received within a predrilled bore for mounting a roof strap or other platelike panel to a stratum in which said bore is drilled, comprising:

(a) an elongated bolt having a head on a lower end thereof, said bolt extending through said platelike panel and within said bore with said head supporting said platelike member in pressed abutment with said stratum;

(b) a thrust nut threadably connected to a lower portion of said bolt for axial movement thereon includes means for reducing the structural integrity of said thrust nut such that a predetermined torquing force exerted on said bolt will disintegrate said nut and thereby indicate that said predetermined torquing force was exerted, wherein said thrust nut is held in non-rotating relation to said stratum by the frictional contact of at least one cutting finger with said stratum and the frictional contact of said thrust nut with an annular base;

(c) an annular base slidably mounted to said bolt and supported by said thrust nut for concomitant movement therewith;

(d) at least one cutting finger integrally connected to said annular base in divergent relation to said bolt and urged upwardly in non-rotating relation to said stratum by said axial movement of said thrust nut to cut at least one groove in said stratum substantially parallel to said bolt and to concurrently seat itself in said groove to secure said bolt within said bore, wherein each said cutting finger has a plurality of substantially parallel cutting edges spaced along a longitudinal axis thereof and extending in substantially transverse relation thereto on an outer side thereof; and (e) means threadably connected to an upper portion of said bolt for urging said cutting fingers outwardly from said bolt to cut said groove and seat therein.

* * * * *